US005531139A

United States Patent [19]

Fanchang et al.

[11] Patent Number: 5,531,139

[45] Date of Patent: Jul. 2, 1996

[54] UNIDIRECTIONAL DRIVE TOOL MECHANISM

[76] Inventors: Wei-Chuan Fanchang, No. 58, Alley 122, Liuh Shan Lane, Nan Yang Road, Feng Yuan, Taichung County; Shih-Yueh Chen, No. 111, Lane 41, Section 1, Hsin Jen Road, Da-Li, Taichung County, both of Taiwan

[21] Appl. No.: 514,801

[22] Filed: Aug. 14, 1995

[51] Int. Cl.[6] ..... B25B 13/46

[52] U.S. Cl. ..... 81/59.1; 81/63.1

[58] Field of Search ..... 81/59.1, 60, 63.1; 192/44, 45

[56] References Cited

U.S. PATENT DOCUMENTS 2,139,650 12/1938 Anderson et al. ..... 81/59.1

3,590,667 7/1971 Berglein ..... 81/59.1

3,640,158 2/1972 Myers ..... 81/59.1 X 4,429,598 2/1984 Tucker ..... 81/59.1

*Primary Examiner*—D. S. Meislin

*Attorney, Agent, or Firm*—Charles E. Baxley

[57] ABSTRACT

A unidirectional drive tool mechanism includes a housing having three or more recesses formed in the inner peripheral surface. A shaft is rotatably engaged in the housing. Three or more pairs of rods are engaged in the recesses and three or more springs may bias the rods to engage with the ends of the recesses. A cap is engaged on the housing and has three or more poles extended inward of the housing for engaging with the rods. The pairs of rods each includes one rod forced to engage with one end portion of the recesses such that the shaft may be driven in one direction only, and each includes the other rod forced to engage with the other end portion of the recesses such that the shaft may be driven in the reverse direction only.

2 Claims, 6 Drawing Sheets

UNIDIRECTIONAL DRIVE TOOL MECHANISM

BACKGROUND OF THE INVENTION

1. Field of the Invention

The present invention relates to a drive tool, and more particularly to a unidirectional drive tool mechanism.

2. Description of the Prior Art

Typical unidirectional drive tool mechanisms comprise a cylindrical housing including a number of recesses formed in the inner peripheral surface thereof for receiving a number of rods therein and including a shaft rotatably engaged therein for engaging with the rods. A number of springs are engaged in the recesses and engaged with the rods so as to bias the rods to engage with one end of the recesses and so as to allow the housing to drive the shaft unidirectionally. Several such typical unidirectional drive tool mechanisms are disclosed in U.S. Pat. No. 1,644,079 to O'Neill; U.S. Pat. No. 1,748,218 to Groves; U.S. Pat. No. 1,904,621 to Kounovsky; U.S. Pat. No. 1,907,584 to Richards; U.S. Pat. No. 3,590,667 to Berglein; U.S. Pat. No. 4,051,935 to Nakayama; U.S. Pat. No. 4,603,606 to Headen; and U.S. Pat. No. 4,873,898 to Chern. However, the drive tools each includes a single rod engaged in each of the recesses only. Some times, the rod may not be effectively engaged with the shaft such that the housing may not effectively and unidirectionally drive the shaft.

The present invention has arisen to mitigate and/or obviate the afore-described disadvantages of the conventional unidirectional drive tool mechanisms.

SUMMARY OF THE INVENTION

The primary objective of the present invention is to provide a unidirectional drive tool mechanism which includes two rods engaged in each of the recesses so as to effectively engage the rods with the shaft and the housing and so as to effectively and unidirectionally drive the shaft.

In accordance with one aspect of the invention, there is provided a unidirectional drive tool mechanism comprising a housing including a hole formed therein and including an inner peripheral surface having at least three recesses formed therein, the recesses each including a first end and a second end, the housing including an outer peripheral surface having a projection means provided thereon, a shaft rotatably engaged in the hole of the housing, at least three pairs of rods engaged in the recesses respectively, the pairs of rods each including a first rod and a second rod for engaging with the first end and the second end of the recesses respectively, at least three biasing means engaged between the pairs of rods respectively so as to bias the first rods and the second rods to engage with the first ends and the second ends of the recesses respectively, and a cap engaged on the housing and including at least three poles extended inward of the housing for engaging with the rods and including an inner peripheral surface having at least two depressions formed therein for engaging with the projection means. The poles are engaged with the first rods so as to bias the second rods to engage with the second ends of the recesses when the projection means is engaged with a first of the two depressions, in order to allow the shaft to be driven in a first direction by the housing and to allow the shaft to rotate freely in a second direction. The poles are engaged with the second rods so as to bias the first rods to engage with the first ends of the recesses when the projection means is engaged with a second of the two depressions, in order to allow the shaft to be driven in the second direction by the housing and to allow the shaft to rotate freely in the first direction.

The rods may be replaced by balls which may also be effectively biased to engage the housing with the shaft such that the housing may effectively drive the shaft in either of the directions.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
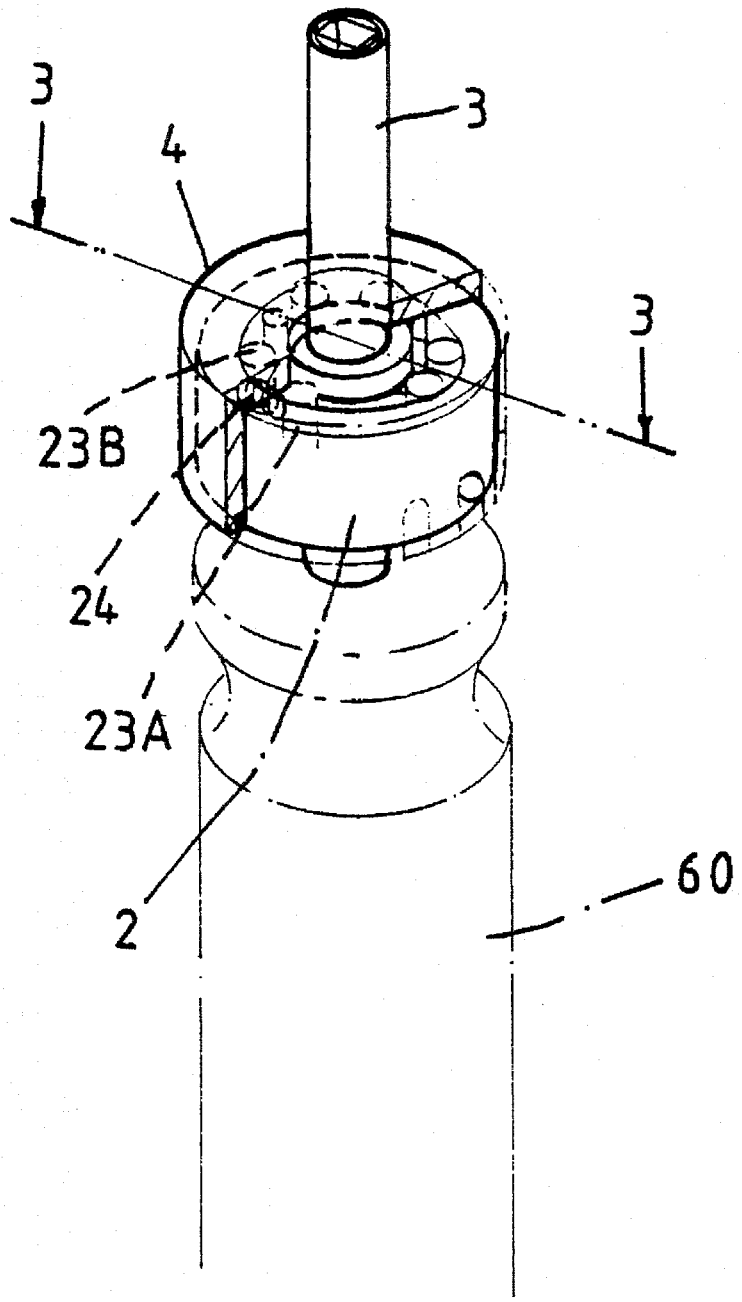
FIG. 1 is a perspective view of a unidirectional drive tool mechanism in accordance with the present invention.
Figure 2:
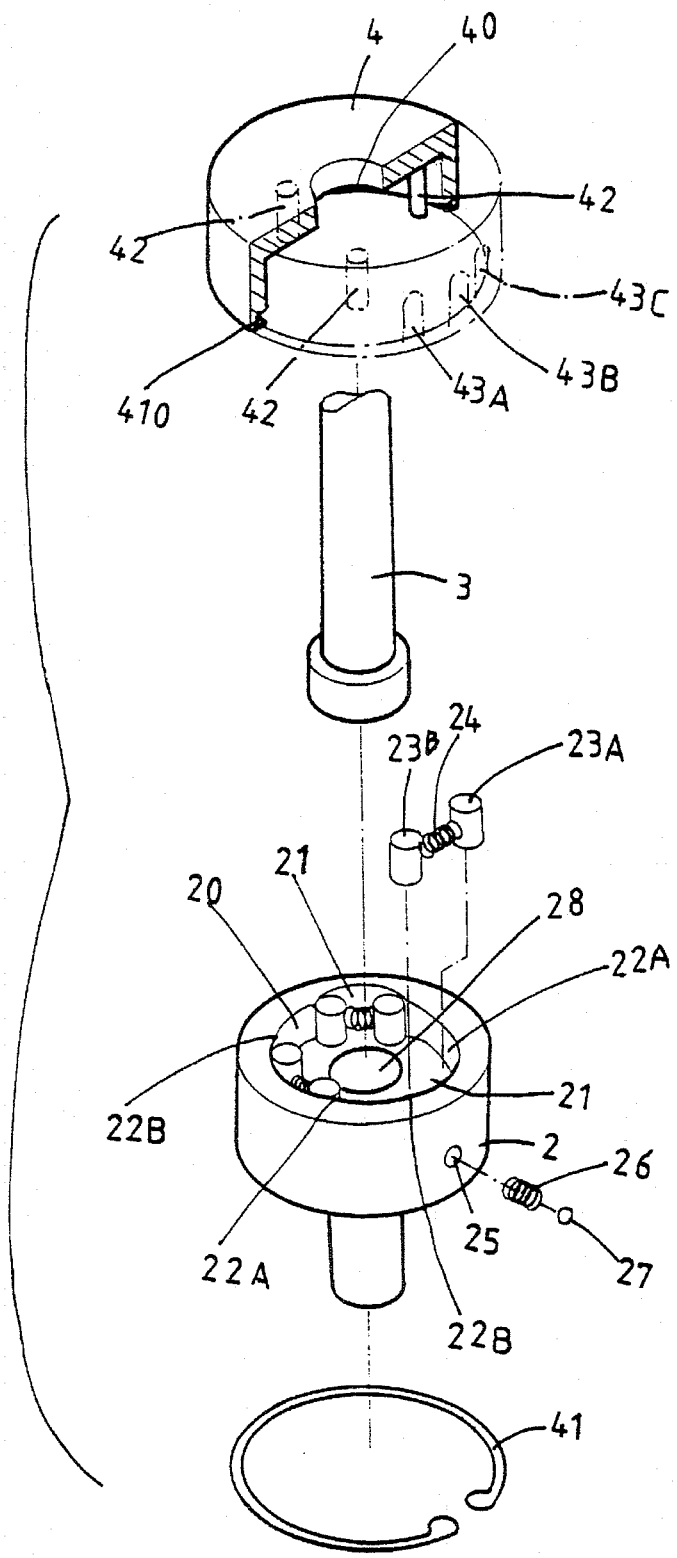
FIG. 2 is an exploded view of the unidirectional drive tool mechanism.
Figure 3:
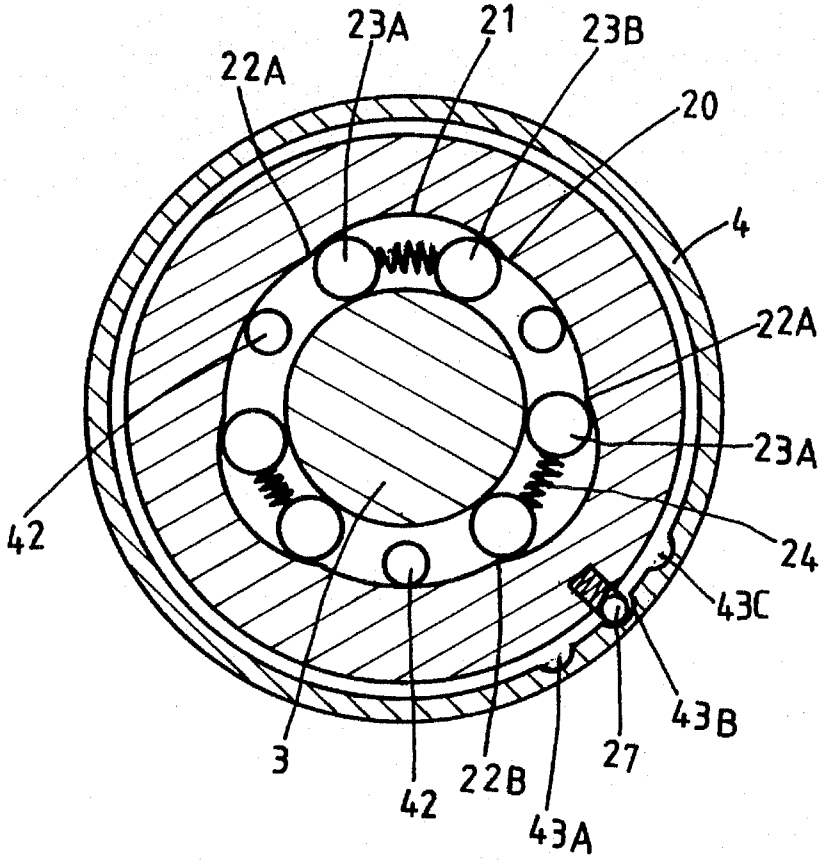

Referring to FIGS. 1 to 3, a unidirectional drive tool mechanism in accordance with the present invention comprises a housing 2 including a cavity 20 formed in the upper portion and including three or more recesses 21 formed in the inner peripheral surface thereof and including a hole 28 formed in the center portion for engaging with a shaft 3. The recesses 21 each includes two end portions 22A, 22B and each includes two rods 23A, 23B received therein for engaging with the shaft 3. A spring 24 is engaged in each of the recesses 21 and engaged between the rods 23A, 23B for biasing the rods to engage with the end portions 22A, 22B of the recesses 21. The housing 2 includes an opening 25 formed in the outer peripheral surface thereof for receiving a projection means including a spring 26 and a ball 27 which may be biased slightly outward of the opening 25 by the spring 26.

A cap 4 is engaged on the housing 2 and includes an orifice 40 formed therein for engaging with the shaft 3 and includes an annular groove 410 formed in the bottom portion thereof for engaging with a retaining ring 41 so as to rotatably secure the cap 4 to the housing 2. The cap 4 includes three or more poles 42 extended inward of the recesses 21 for engaging with the rods 23A, 23B. The cap 4 includes an inner peripheral surface having three depressions 43A, 43B, 43C formed therein for engaging with the ball 27 such that the cap 4 may be stably secured to the housing 2 at either of three angular positions when the ball 27 is engaged with either of the depressions 43A, 43B, 43C.

Figure 6:
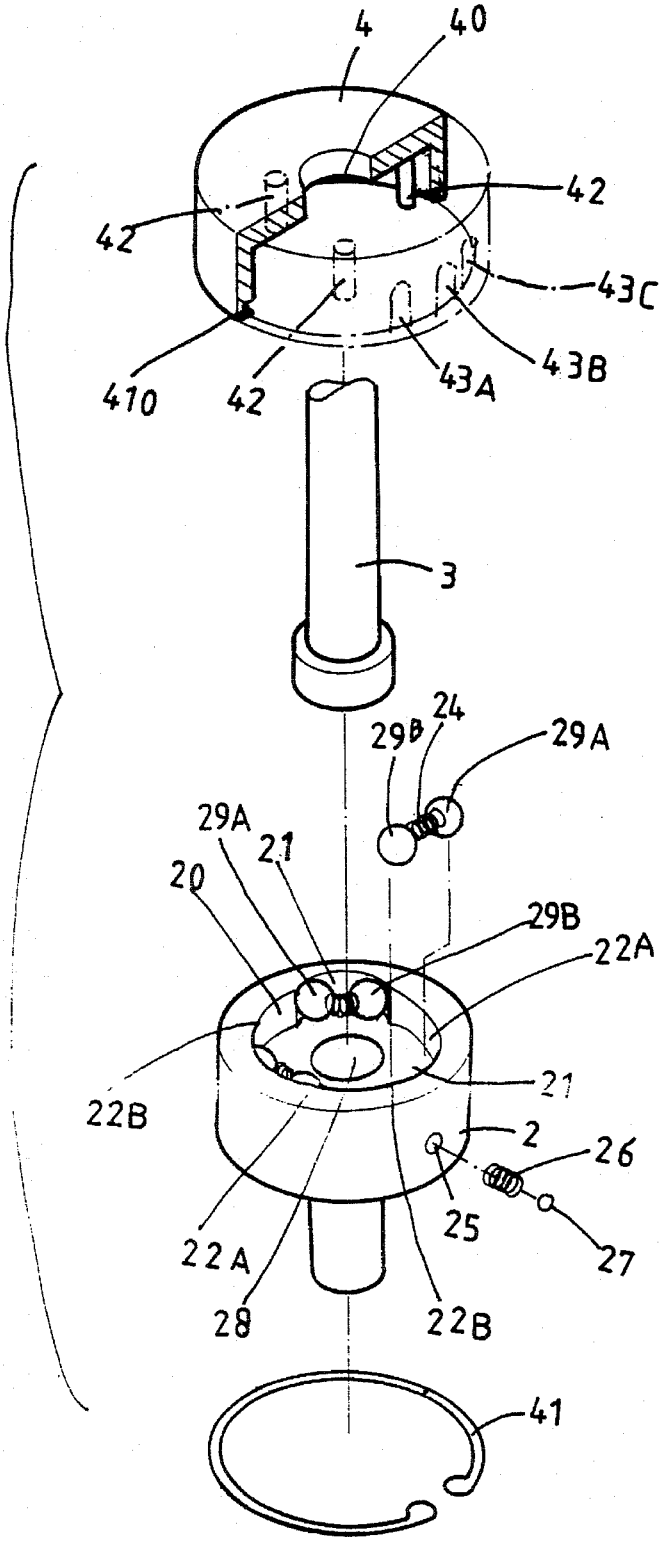
FIG. 6 is an exploded view illustrating another application of the undirectional drive tool mechanism.

Alternatively, as shown in FIG.6, two balls 29A, 29B may be received in each of the recesses 21 for engaging with the shaft 3, and the spring 24 is engaged between the balls 29A, 29B for biasing the balls 29A, 29B to engage with the end portions 22A, 22B of the recesses 21.

In operation, as shown in FIG.3, when the ball 27 is engaged with the center depression 43B, the poles 42 are not engaged with the rods 23A, 23B or the balls 29A, 29B. At this moment, the rods 23A, 23B or the balls 29A, 29B are engaged with the end portions 22A, 22B of the recesses 21 such that the shaft 3 may be driven by the housing 2 to rotate in both the clockwise and the counterclockwise directions.

Figure 4:
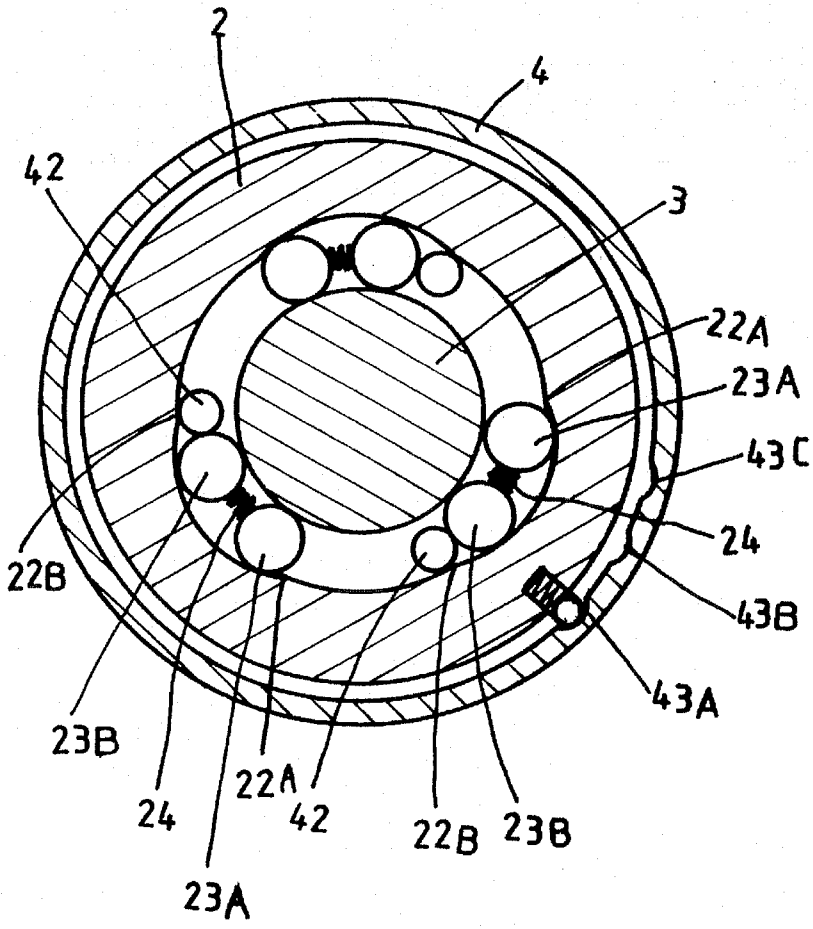
FIGS. 3, 4, 5 are cross sectional views of the unidirectional drive tool mechanism, taken along lines 3—3 of FIG. 1.

As shown in FIG. 4, when the cap 4 is rotated counterclockwise relative to the housing 2 so as to engage the ball 27 with the depression 43A, the poles 42 are engaged with the rods 23B or the balls 29B so as to bias the rods 23A or the balls 29A to engage with the end portion 22A of the recesses 21. At this moment, the rods 23B or the balls 29B are not engaged with the end portions 22B of the recesses 21 such that the shaft 3 may be driven by the housing 2 to rotate in the clockwise direction and may not be driven to rotate in the counterclockwise direction.

Figure 5:
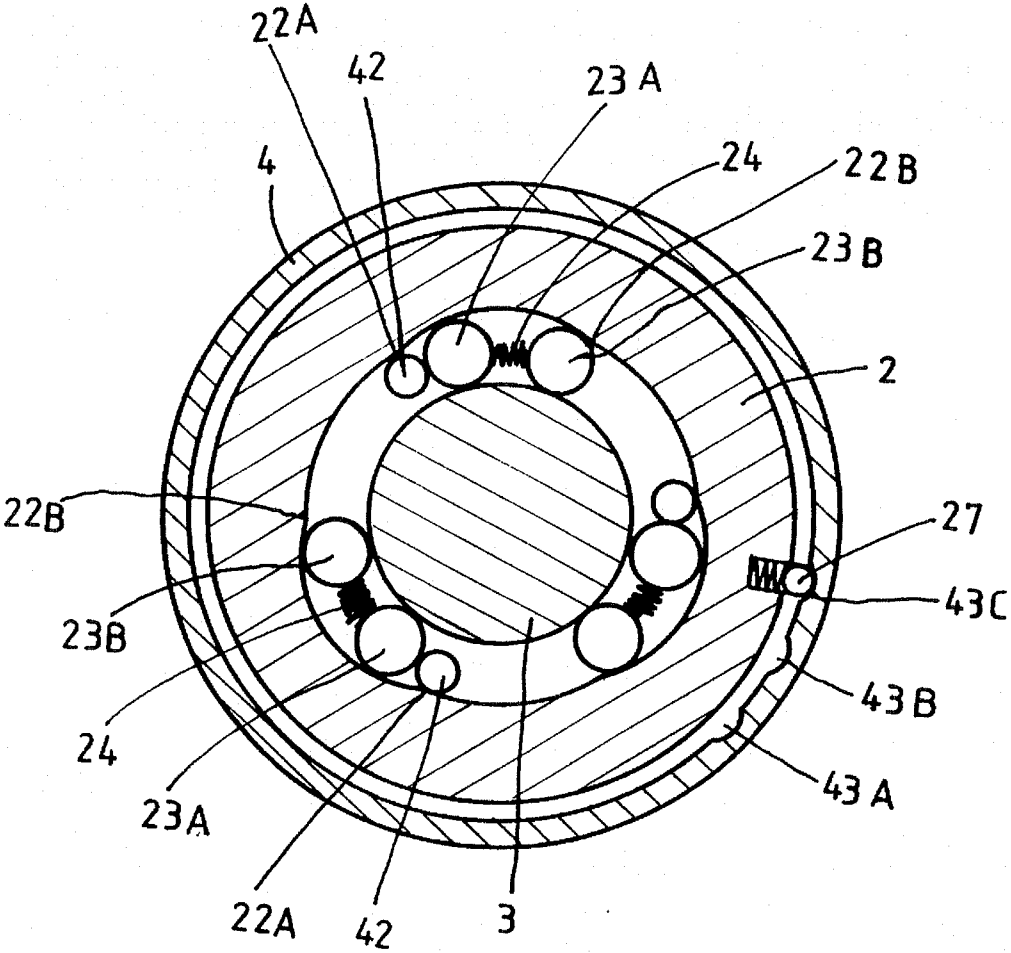

As shown in FIG. 5, when the cap 4 is rotated clockwise relative to the housing 2 so as to engage the ball 27 with the depression 43C, the poles 42 are engaged with the rods 23A or the balls 29A so as to bias the rods 23B or the balls 29B to engage with the end portion 22B of the recesses 21. At this moment, the rods 23A or the balls 29A are not engaged with the end portions 22A of the recesses 21 such that the shaft 3 may be driven by the housing 2 to rotate in the counterclockwise direction and may not be driven to rotate in the clockwise direction.

It is to be noted that the rods and balls may be solidly biased to engage with the end portions of the recesses by the poles. If the poles 42 are acted on the springs 24 so as to bias the rods and balls to engage with the end portions of the recesses, the rods and balls may not be effectively and precisely forced to engage with the end portions of the recesses.

Figure 7:
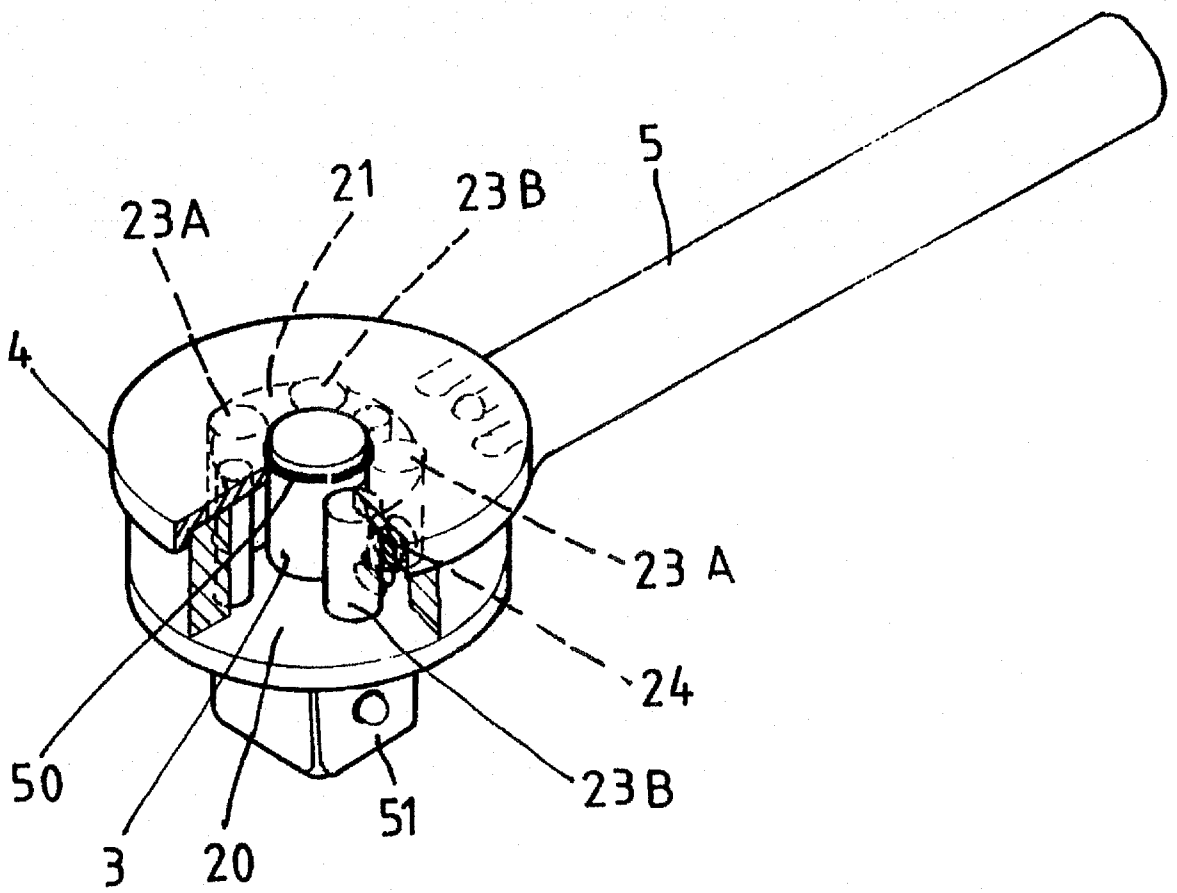
FIG. 7 is a perspective view illustrating another embodiment of the unidirectional drive tool mechanism in accordance with the present invention, in which part of the drive tool is cutoff for showing the interior of the drive tool.

As shown in FIG. 1, when a handle 60 is secured to the housing 2, the drive tool may be used as a ratchet screw driver. However, as shown in FIG. 7, when a handle 5 is secured to the housing 2 and when the shaft 3 includes a driving stud 51 formed in the bottom, the drive tool may be used as a ratchet wrench.

Accordingly, the unidirectional drive tool mechanism in accordance with the present invention includes two rods or two balls engaged in each of the recesses so as to effectively engage the rods with the shaft and the housing and so as to effectively and unidirectionally drive the shaft.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A unidirectional drive tool mechanism comprising:

a housing including a hole formed therein and including an inner peripheral surface having at least three recesses formed therein, said recesses each including a first end and a second end, said housing including an outer peripheral surface having a projection means provided thereon, a shaft rotatably engaged in said hole of said housing, at least three pairs of rods engaged in said recesses respectively, said pairs of rods each including a first rod and a second rod for engaging with said first end and said second end of said recesses respectively, at least three biasing means engaged between said pairs of rods respectively so as to bias said first rods and said second rods to engage with said first ends and said second ends of said recesses respectively, and a cap engaged on said housing and including at least three poles extended inward of said housing for engaging with said rods and including an inner peripheral surface having at least two depressions formed therein for engaging with said projection means, said poles being engaged with said first rods so as to bias said second rods to engage with said second ends of said recesses when said projection means is engaged with a first of said two depressions, in order to allow said shaft to be driven in a first direction by said housing and to allow said shaft to rotate freely in a second direction; and said poles being engaged with said second rods so as to bias said first rods to engage with said first ends of said recesses when said projection means is engaged with a second of said two depressions, in order to allow said shaft to be driven in said second direction by said housing and to allow said shaft to rotate freely in said first direction.

2. A unidirectional drive tool mechanism comprising:

a housing including a hole formed therein and including an inner peripheral surface having at least three recesses formed therein, said recesses each including a first end and a second end, said housing including an outer peripheral surface having a projection means provided thereon, a shaft rotatably engaged in said hole of said housing, at least three pairs of balls engaged in said recesses respectively, said pairs of balls each including a first ball and a second ball for engaging with said first end and said second end of said recesses respectively, at least three biasing means engaged between said pairs of balls respectively so as to bias said first balls and said second balls to engage with said first ends and said second ends of said recesses respectively, and a cap engaged on said housing and including at least three poles extended inward of said housing for engaging with said balls and including an inner peripheral surface having at least two depressions formed therein for engaging with said projection means, said poles being engaged with said first balls so as to bias said second balls to engage with said second ends of said recesses when said projection means is engaged with a first of said two depressions, in order to allow said shaft to be driven in a first direction by said housing and to allow said shaft to rotate freely in a second direction; and said poles being engaged with said second balls so as to bias said first balls to engage with said first ends of said recesses when said projection means is engaged with a second of said two depressions, in order to allow said shaft to be driven in said second direction by said housing and to allow said shaft to rotate freely in said first direction.

* * * * *